United States Patent [19]

Murphy

[11] Patent Number: 4,978,079

[45] Date of Patent: Dec. 18, 1990

[54] SHREDDER-MIXER

[76] Inventor: Harry Murphy, 2175 NW. 69th, Oklahoma City, Okla. 73116

[21] Appl. No.: 468,530

[22] Filed: Jan. 23, 1990

[51] Int. Cl.[5] ..... B02C 13/286

[52] U.S. Cl. ..... 241/81; 241/101.7; 241/186 R; 241/190; 241/194

[58] Field of Search ..... 241/81, 190, 186 R, 241/194, 195, 189 R, 101.7

[56] References Cited

U.S. PATENT DOCUMENTS 4,030,865 6/1977 Kobayashi ..... 241/189 R X
4,193,556 3/1980 Linnerz et al. ..... 241/186 R

FOREIGN PATENT DOCUMENTS 426695 1/1975 U.S.S.R. ..... 241/189 R

OTHER PUBLICATIONS

Royer Foundry & Machine Co. Brochure, 1981.
Powerscreen International Brochure.
Powerscreen of America Brochure.
Lindig Brochure.

*Primary Examiner*—Mark Rosenbaum
*Attorney, Agent, or Firm*—Dunlap, Codding, Peterson & Lee

[57] ABSTRACT

A machine for preparing soil mixes and the like utilizing a hopper and a conveyor forming a live bottom for the hopper to convey the materials into a shredding chamber. A hammer mill type apparatus is positioned in the shredding chamber to shred and mix the materials. The hammer mill apparatus works in cooperation with spring-loaded bars and with stationary bars which retard the bypassing of material around the hammer mill.

6 Claims, 3 Drawing Sheets

SHREDDER-MIXER

BRIEF SUMMARY OF THE INVENTION

1. Field of The Invention

This invention relates to improvements in machines for preparing soil mixes and the like.

2. Background of The Invention

There is a need for a high production, low cost machine for producing what are commonly known as soil mixes or growing mixes utilizing, generally speaking, top soil, sand, compost, manures, peat moss, fine wood chips and agricultural gypsum. Up until now, the available equipment is either of extremely limited capacity or unduly expensive, and none of the presently available machines provide an effective shredding and mixing operation.

The present machine is a portable, high capacity machine, typically produced in a size to have a capacity of 100 cubic yards per hour of a soil mix. The machine basically includes a hopper with a conveyor therein forming a live bottom to the hopper for conveying materials from the hopper to a shredder provided at one end of the machine, such that the machine can be operated on a fairly constant basis. The shredder is a hammer mill type of device with means to prevent the bypassing of materials around the hammer mill and provide an efficient, effective shredding operation.

DETAILED DESCRIPTION OF THE DRAWINGS

Figure 1:
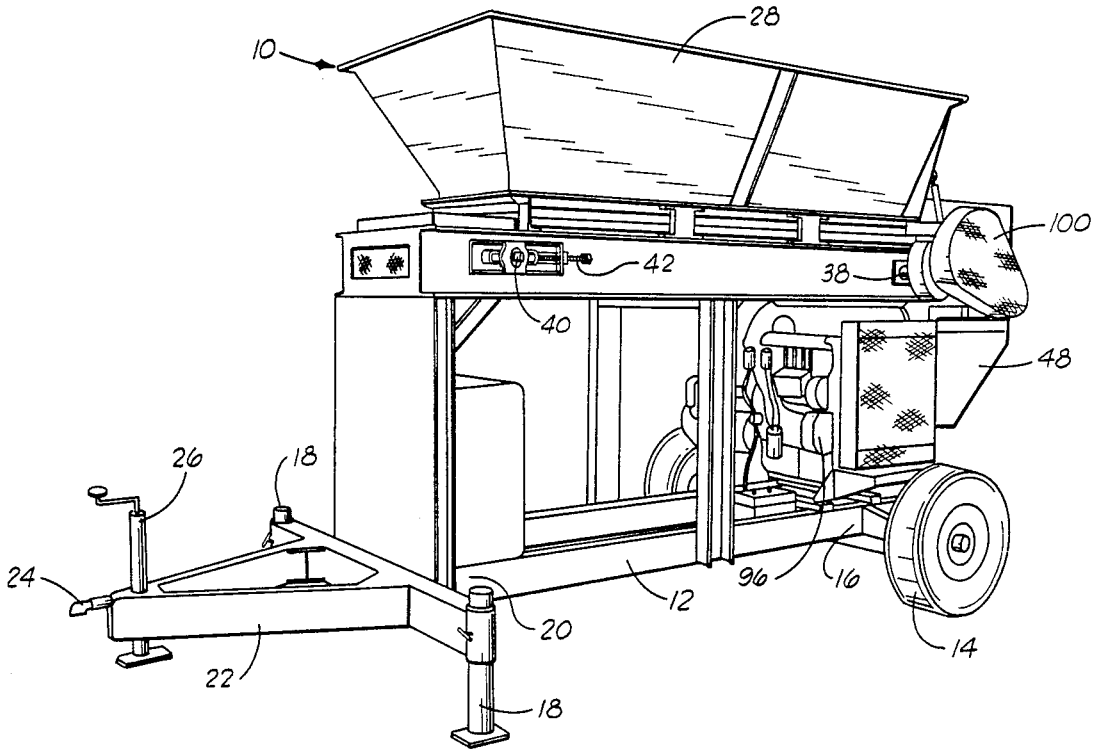
FIG. 1 is a perspective view of the machine looking generally at one side and the front of the machine.
Figure 2:
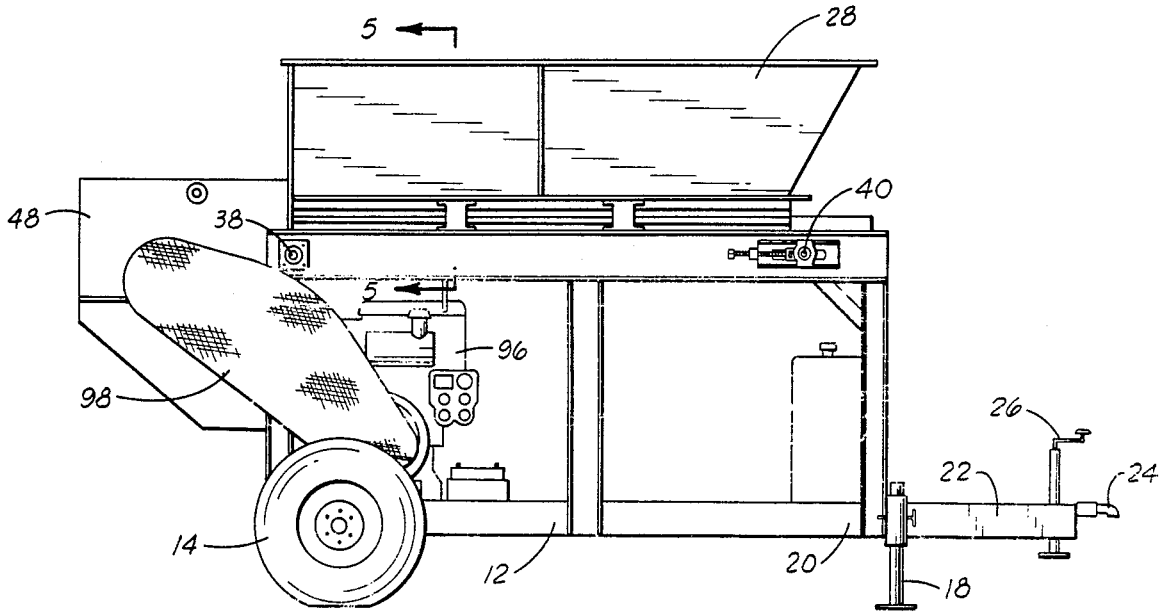
FIG. 2 is an elevational view of the opposite side of the machine.
Figure 3:
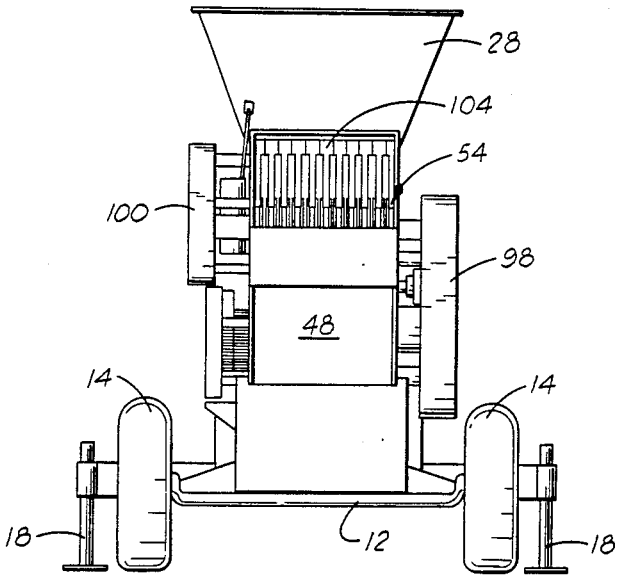
FIG. 3 is an end elevational view of looking at the rear end of the machine.

Referring to the drawings in detail, and particularly FIGS. 1 and 2, reference character 10 generally designates a machine constructed pursuant to this invention. The machine 10 includes a generally rectangular frame 12 having a pair of wheels 14 supporting the rear end 16 of the frame and adjustable feet 18 for supporting the front end 20 of the frame when the machine is in an operating position. An extension 22 is provided on the front end of the frame 12 to support the female portion 24 of a hitch, by means of which the machine 10 can be towed from one operating position to the other. A hand operated jack 26 is provided on the extension 22 to facilitate the connection and disconnection of the ball joint connecting portion 24.

Figure 4:
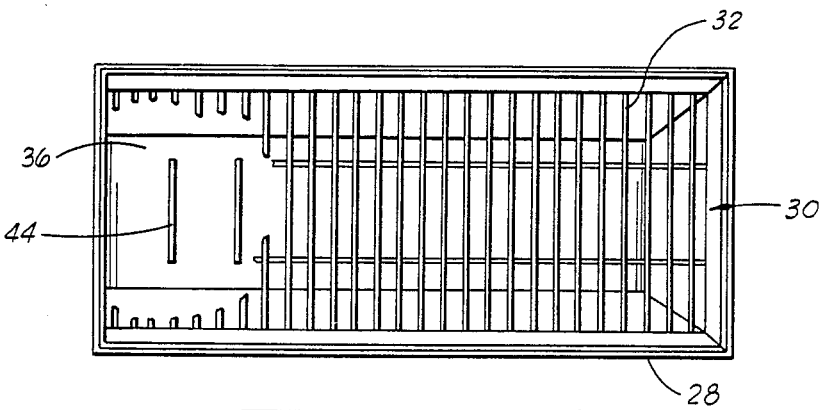
FIG. 4 is a top view looking down into the hopper of the machine, with portions of the structure broken away for illustrative purposes.
Figure 5:
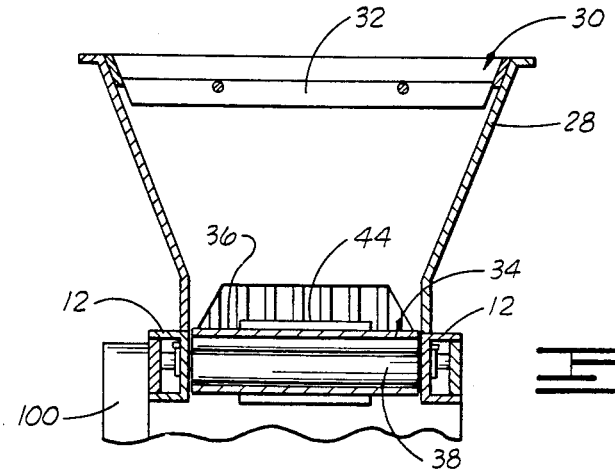
FIG. 5 is a cross sectional view taken along lines 5—5 of FIG. 2.
Figure 6:
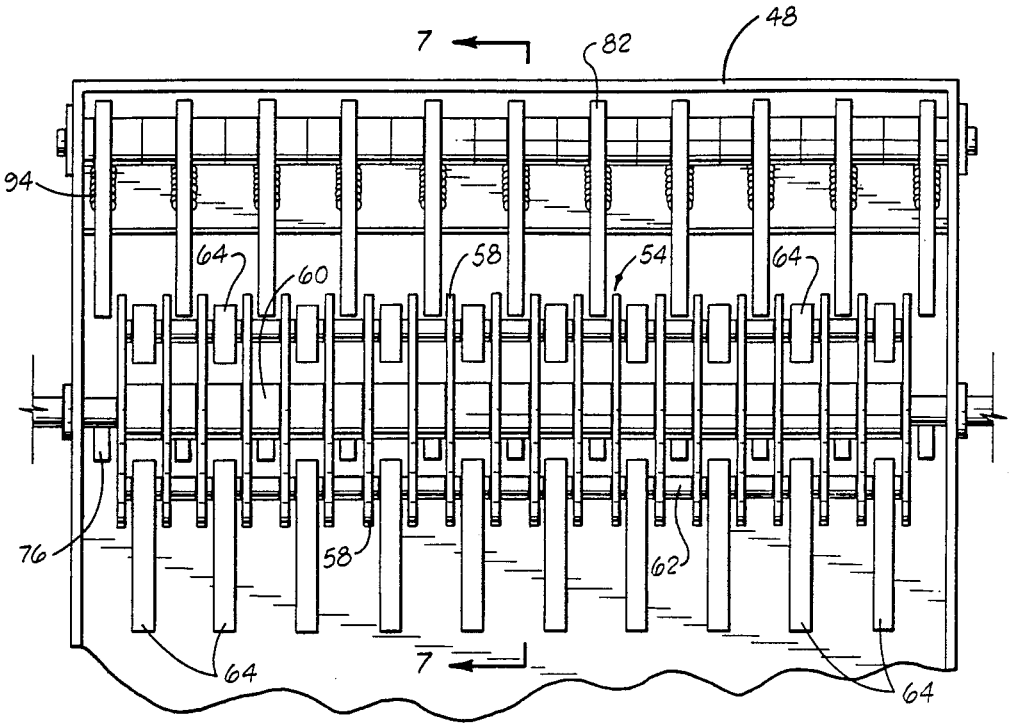
FIG. 6 is an elevational view looking into the rear end of the shredder mechanism.

A hopper 28 is supported on the top of the frame 12 and has a grissly 30 removably positioned in the top of the hopper as shown in FIGS. 4 and 5. The grissly 30 has spaced bars 32 therein for sizing the materials which can be fed into the hopper 28, as by use of a front end loader (not shown). The sidewalls of the hopper 28 are tapered downwardly and inwardly, with the bottom of the hopper being open in the sense that there is no stationary bottom of the hopper.

A conveyor generally designated at 34 is supported in the frame 12 in a position to form a live bottom for the hopper 28. The conveyor 34 comprises an endless belt 36 extending around a drive shaft 38 adjacent the rear end 16 of the frame 12 and an idler shaft 40 near the rear end 20 of the frame 12. The tension of the belt 36 can be adjusted by means of a conventional adjusting mechanism 42 attached to the idler shaft 40. Suitable cleats 44 are provided on the conveyor belt 36 to assist in the transporting of materials from the hopper 28 into a shredding chamber 46 formed by a housing 48 mounted on the rear end 16 of the frame 12.

Figure 7:
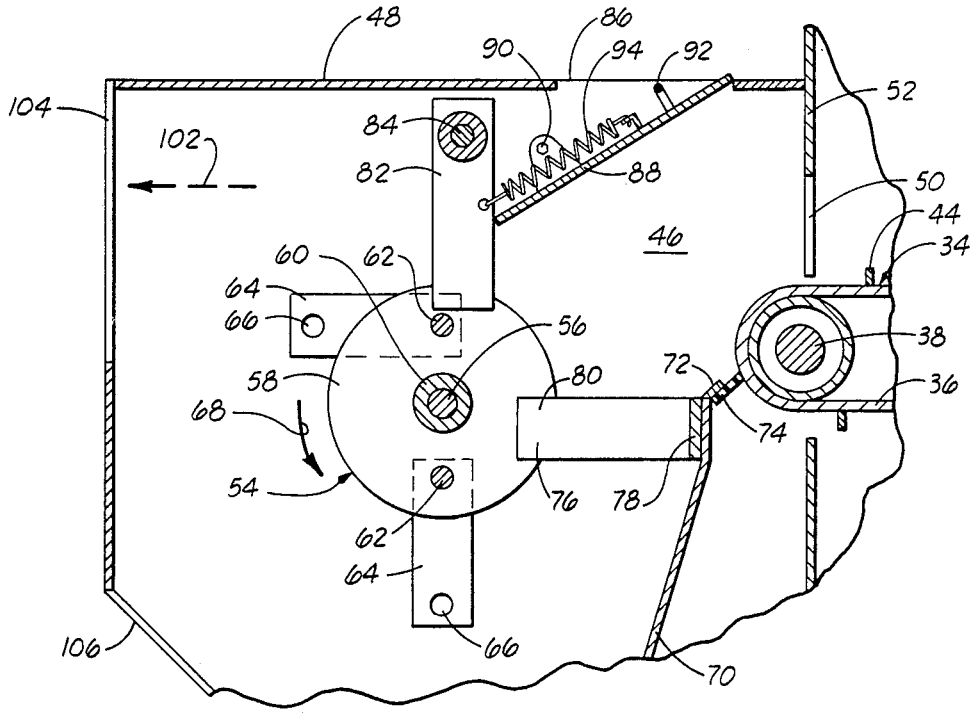
FIG. 7 is a cross sectional view taken along lines 7—7 of FIG. 6.

As shown in FIG. 7, the rear end of the conveyor 34 (which extends around the driven shaft 38) extends into the shredding chamber 46 through an opening 50 in the front wall 52 of the housing 48. A hammer mill 54 is supported in the chamber 46 on a shaft 56 extending parallel with the conveyor drive shaft 38. The shaft 56 is suitably journaled in the side walls of the housing 48.

The hammer mill 54 includes a plurality of circular plates 58 mounted on the shaft 56 and held in spaced apart relation along the shaft by tubular spacers 60. Each plate 58 is apertured to receive the shaft 56 and is secured to the shaft 56 (as being keyed to the shaft), whereby the plates 58 will turn with the shaft.

A pair of shafts 62 extend through mating apertures in the plates 58 on opposite sides of and parallel with the shafts 56. A hammer 64 is pivotally secured on each shaft 62 between every other pair of plates 58. Each hammer 64 is provided with an aperture 66 in each end portion thereof sized to receive either one of the shafts 62, whereby the hammers 64 may be reversed in the event of wear of the hammer. The shaft 56, and hence the plates 58 and hammers 64 are turned in the direction indicated by the solid arrow 68 to shred materials fed into the shredding chamber 46 by the conveyor 34.

A tapered wall 70 extends across the shredding chamber 46 and extends upwardly to a position slightly below the discharge end of the conveyor 34. A mounting plate 72 is secured to the top of the wall 70 and an elastomeric seal 74 is secured to the plate 72 to extend into sliding contact with the belt 36 of the conveyor 34 to prevent the discharge of material around the front side of the plate 70 between the plate 70 and the front wall 52 of the housing 48. A plurality of bars 76 are secured to the top edge of the wall 70 by means of a mounting plate 78. Each bar 76 extends substantially horizontally with the rear end portion 80 thereof extending between every other pair of plates 58 in the spaces between the plates not occupied by the hammers 64. The bars 76 extend from between the plates 58 to approximately the discharge end of the conveyor 34 and at a level slightly below the discharge end of the conveyor 34.

A spring-loaded bar 82 is pivotally supported on a shaft 84 extending transversely across the housing 48, with at least a portion of each bar 82 aligned with the shaft 56 of the hammer mill 54. Each spring-loaded bar 82 extends downwardly between an adjacent pair of the plates 58 in spaces occupied by the horizontal bars 76 and in spaces not occupied by the hammers 64.

A clean-out opening 86 is provided in the top wall of the housing 48 essentially between the hammer mill 54 and the discharge end of the conveyor 34. The clean-out opening 86 is normally closed by a deflector plate 88 pivotally secured by a horizontally extending shaft 90. A lifting handle 92 is provided on the plate 88 to turn the plate 88 when it is desired to gain access to the shredding chamber 46 for clean out purposes. A tension spring 94 has one end secured to the plate 88 and its opposite end secured to one of the respective spring loaded bars 82, it being understood that there is a tension spring 94 for each one of the bars 82.

As shown in FIGS. 1 and 2, an engine 96 is supported in the rear end portion of the frame 12. A driving connection 98, such as in the form of a chain drive, extends from one end of the drive shaft of the engine 96 to one end of the shaft 56 of the hammer mill 54. The opposite end of the hammer mill shaft 56 is connected by a suitable drive, such as a chain drive 100 to the driven shaft 38 of the conveyor 34, such that the engine 96 drives both the hammer mill 54 and the conveyor 34.

OPERATION

In a preferred operation, the materials to be combined into the soil mix are preferably dumped, one on top of each other, into a suitably sized pile. A front end loader is then preferably used for taking quantities of the stacked materials and dumping them into the hopper 28, such that each load of materials introduced into the hopper 28 will include the desired ratios of the materials to be utilized in the final mix. The grissly 30 limits the size of materials which will be fed into the machine, such that large pieces of wood or large stones will not be fed into the hammer mill.

Materials from the hopper 28 are conveyed by the conveyor 34 into the shredding chamber 46 at a fairly uniform rate. The hammers 64 of the hammer mill 54 will engage those materials and provide a shredding and a mixing operation. The hammers 64 cooperate with the spring-loaded bars 82 in reducing the particle size of the materials. The shredded and mixed materials are discharged from the housing 48 in the direction of the dashed arrow 102 out through a discharge opening 104 of the housing 48. The mixed material may then be stored or bagged for sale.

The horizontal bars 76 prevent any of the materials being fed to the shredding chamber 46 from bypassing downwardly around the hammer mill 54. Any very small particles of material which may pass through the bars 76 are discharged through an opening 106 in the lower portion of the housing 48 and may be reclaimed in any desired fashion.

Changes may be made in the combination and arrangement of parts or elements as set forth in the specification and shown in the drawing without departing from the spirit and scope of the invention as defined in the following claims.

What is claimed is:

1. A machine for preparing soil mixes and the like, comprising:

a frame;

a hopper mounted on the frame for receiving the materials to be mixed;

a housing on the frame forming a shredding chamber;

a conveyor forming a live bottom for the hopper and having its discharge end extending into the shredding chamber for conveying the materials to be shredded into the shredding chamber;

a shaft extending across the shredding chamber at a right angle to the conveyor and spaced from the discharge end of the conveyor;

means for turning the shaft in the same direction as the discharge end of the conveyor;

a plurality of hammers pivotally carried by the shaft in spaced apart relation along the length of the shaft;

a spring-loaded bar pivotally secured to the housing in the shredding chamber extending downwardly between the paths of movement of each adjacent pair of hammers; and a horizontally extending bar secured in the housing in the shredding chamber between the shaft and the discharge end of the conveyor extending from between the paths of movement of the hammers to substantially the discharge end of the conveyor at a level below the discharge end of the conveyor, said horizontally extending bars being positioned to retard the bypassing of material around the hammers.

2. A machine as defined in claim 1 characterized further to include a grissly mounted in the top of the hopper.

3. A machine as defined in claim 1 wherein said housing has a clean out opening in the top thereof generally above the horizontally extending bars, and a deflector plate pivotally secured to the housing positioned to normally prevent the flow of material out of the clean out opening.

4. A machine as defined in claim 3 characterized further to include a tension spring secured to each spring-loaded bar and the deflector plate urging the spring-loaded bars toward one end of the deflector plate.

5. A machine as defined in claim 1 characterized further to include:

a plurality of circular plates, each plate having an aperture generally in the center thereof receiving the shaft and each plate being secured on the shaft to turn with the shaft;

a spacer on the shaft between each pair of adjacent circular plates holding the plates in spaced apart relation along the shaft; and a pair of rods extending through mating apertures in the circular plates on opposite sides of and parallel with the shaft; and each of said hammers being pivotally mounted on one of said rods, there being a pair of hammers between every other pair of circular plates.

6. A machine as defined in claim 5 wherein each hammer has an aperture in each end portion thereof sized to receive one of the said rods, whereby the hammer may be reversed when worn.

* * * * *